US005645027A

United States Patent [19]

Esmailzadeh

[11] Patent Number: 5,645,027

[45] Date of Patent: Jul. 8, 1997

[54] ORBITING PISTON COMBUSTION ENGINE

[76] Inventor: Karim Esmailzadeh, 3905 Viola Rd. Northeast, Rochester, Minn. 55906

[21] Appl. No.: 616,234

[22] Filed: Mar. 13, 1996

Related U.S. Application Data

[63] Continuation of Ser. No. 369,740, Jan. 6, 1995, abandoned.

[51] Int. Cl.[6] ..... F02B 53/00

[52] U.S. Cl. ..... 123/245; 418/33

[58] Field of Search ..... 123/245, 240; 418/33, 35

[56] References Cited

U.S. PATENT DOCUMENTS

| | | | |
|---|---|---|---|
| 488,277 | 12/1892 | Hamilton | 418/35 |
| 813,974 | 2/1906 | King | 418/33 |
| 830,124 | 9/1906 | Weeks | 418/35 |
| 4,033,299 | 7/1977 | Manzoni | 123/240 |

FOREIGN PATENT DOCUMENTS

| | | | |
|---|---|---|---|
| 1227082 | 2/1960 | France | 123/245 |

*Primary Examiner*—Michael Koczo

*Attorney, Agent, or Firm*—Palmatier, Sjoquist Helget & Voigt, P.A.

[57] ABSTRACT

An orbiting piston combustion engine includes a toroidal cylindrical block with a continuous toroidal cylinder within the block. Within the cylinder is a continuously orbiting piston assembly which includes a compression piston with a compression chamber therebehind in the direction of rotation within the cylinder and a power piston with a combustion chamber therebehind in the direction of rotation within the cylinder. A power transfer mechanism is engageable with the continuously orbiting piston assembly for power transfer from the engine.

20 Claims, 4 Drawing Sheets

ORBITING PISTON COMBUSTION ENGINE

This is a continuation of U.S. patent application Ser. No. 08/369,740, filed Jan. 6, 1995, now abandoned.

BACKGROUND OF THE INVENTION

The present invention relates to a combustion engine, and more particularly to an orbiting piston combustion engine with a continuous toroidal cylinder and a continuously orbiting piston assembly within the cylinder.

Four cycle engines are well known and their cycles include: (1) intake of gas and air; (2) compression of the air and gas; (3) ignition and power stroke; and (4) exhaust.

Also, two cycle engines are well known wherein their cycles include: (1) pushing exhaust out with air, gas and oil intake; and (2) ignition and power stroke.

The principal problem of two cycle and four cycle engines are their inertial loss due to the reciprocating pistons. One attempt to overcome the inertial loss has been the rotary engine. However, the rotary engine has not met with great success as it is quite complicated and more difficult to perform maintenance thereon.

There is a need for a new engine that will overcome inertial loss and be extremely simple in design while yet achieving all the benefits of lightweight efficiency, minimal pollution and available for any number of configurations or sizes.

SUMMARY OF THE INVENTION

An orbiting piston combustion engine includes a toroidal cylindrical block with a continuous toroidal cylinder within the block. Within the cylinder is a continuously orbiting piston assembly which includes a compression piston with a compression chamber therebehind in the direction of rotation and a power piston with a combustion chamber therebehind in the direction of rotation. A power transfer mechanism is engageable with the continuously orbiting piston assembly for power transfer from the engine.

A principal object and advantage of the present invention, concept and design is its availability to be made in many configurations such as circular, elliptical or toroidal which will permit a variety of cylinder and piston shapes to include circular or elliptical, and square or round respectfully.

Another object and advantage of the present invention is that a variety of different sequences of operation, referred to herein as orbiting sections, may be greatly increased.

Another object and advantage of the present invention is that the number of orbiting pistons may be as low as one pair and up to many pairs for large engines.

Another object and advantage of the present invention is that power can be taken out of the engine from one to many pistons from the same orbit with more than one power transfer and starting gear mechanisms.

Another object and advantage of the present invention is that power take off from the engine can be designed in many ways to transfer power from the orbiting pistons to the power shaft by other types of movements beyond the gear type shown herein.

Another object and advantage of the present invention is that the orbiting piston assembly may be designed to run clockwise or counterclockwise.

Another object and advantage of the present invention is that the engine may be installed in any position with any orientation irrespective of gravity.

Another object and advantage of the present invention is that it may be designed for air or liquid cooling systems or any other methods.

Another object and advantage of the present invention is that the orbiting piston combustion engine may be designed for standard combustion air intake, supercharged air, turbocharged air, or any other methods.

Another object and advantage of the present invention is that the combustion engine can use most any kind of fuel, including a mixture of fuel and oil, including diesel fuel.

Another object and advantage of the present invention is it is lightweight, provides more horsepower per pound of engine and operates much smoother and more balanced than any prior combustion engine.

Another object of the present invention is that the orbiting piston combustion engine may be coupled together to increase horsepower in a module system arrangement.

Another object and advantage of the present invention is that it is comprised of less parts and therefore less wear and tear for a longer life without reconstruction and a considerably less cost than conventional engines.

Another object and advantage of the present invention is that the engine may be overhauled with a replacement kit consisting only of cylinder sleeves and orbiting piston assemblies.

Another object and advantage of the present invention is that the engine permits a variety of diameters and sizes for the orbiting pistons and orbital cylinder.

Another principal object and advantage of the present invention is that it is of an ultra high fuel efficiency utilizing considerably less fuel with minimal exhaust pollution.

Other objects and advantages will become readily apparent upon review of the following figures, specification and appended claims.

DETAILED SPECIFICATION

Figure 1:
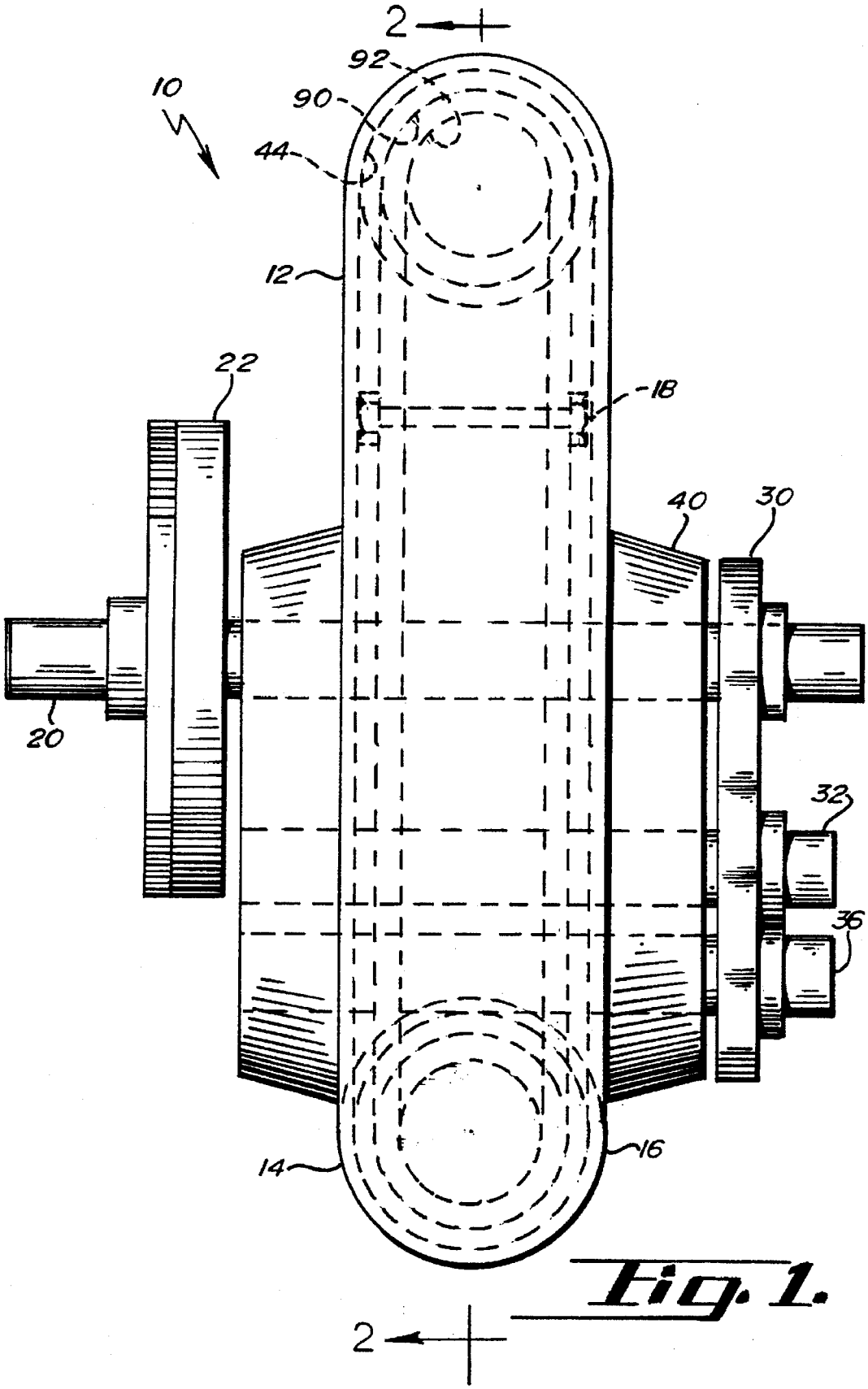
FIG. 1 is an elevational view of the orbiting piston combustion engine of the present invention which is shown to be toroidal and possibly elliptical in the plane along lines 2—2.
Figure 2:
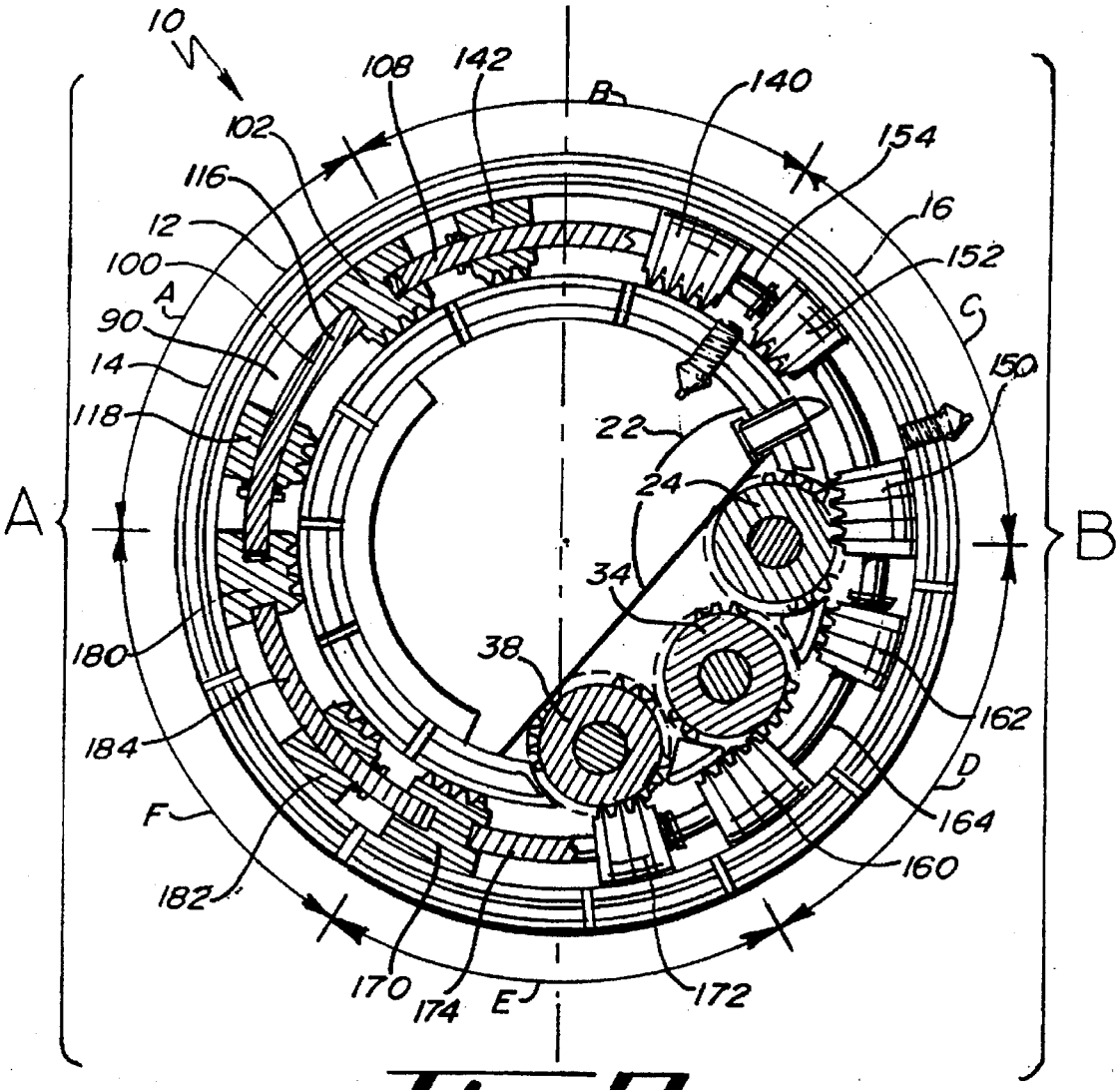
FIG. 2 is a cross-sectional view taken along lines 2—2 of FIG. 1 with the orbiting piston assembly shown partially broken away.
Figure 3:
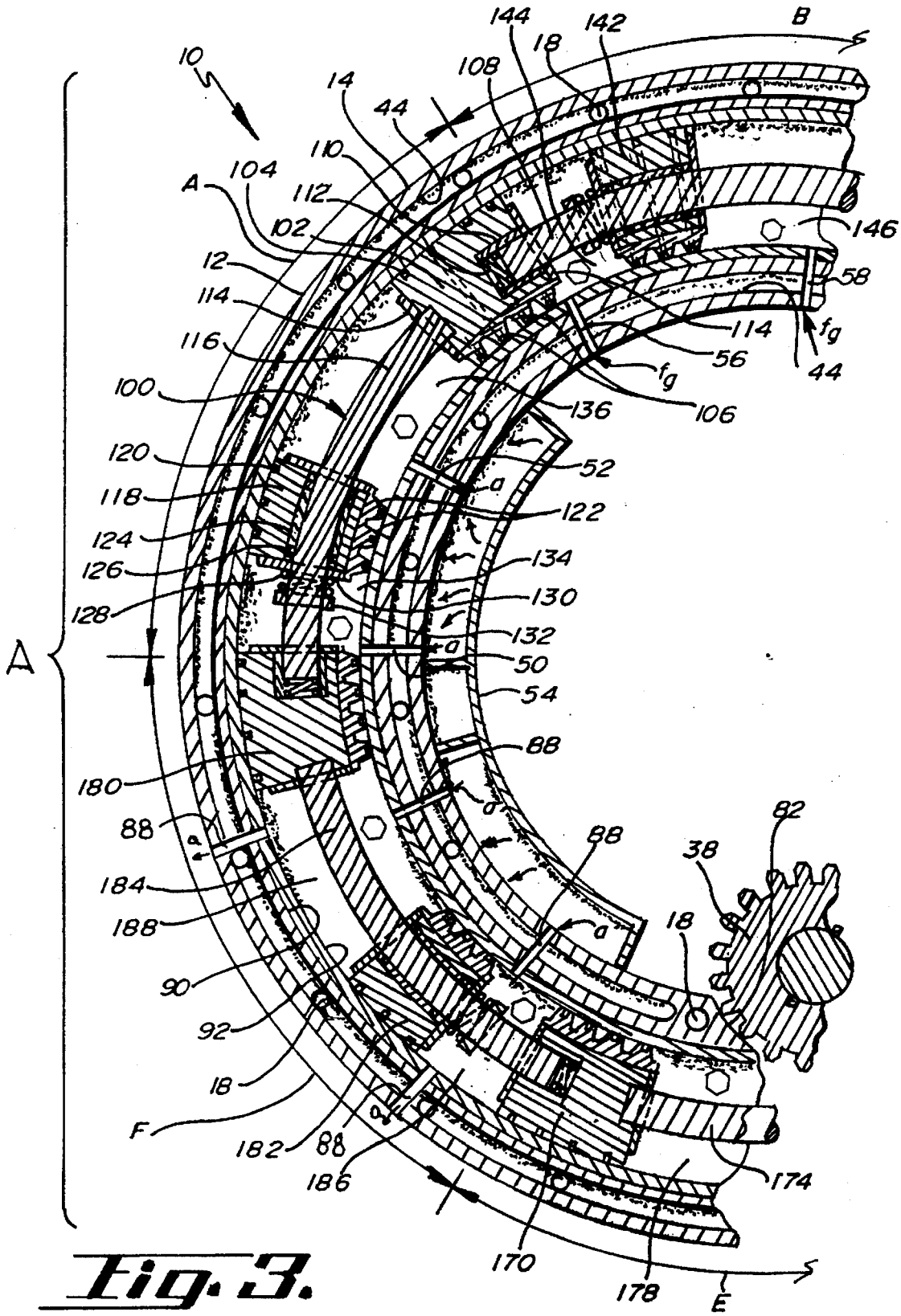
FIG. 3 is an enlarged detailed cross-sectional view of the bracketed A portion of the combustion engine from FIG. 2.
Figure 4:
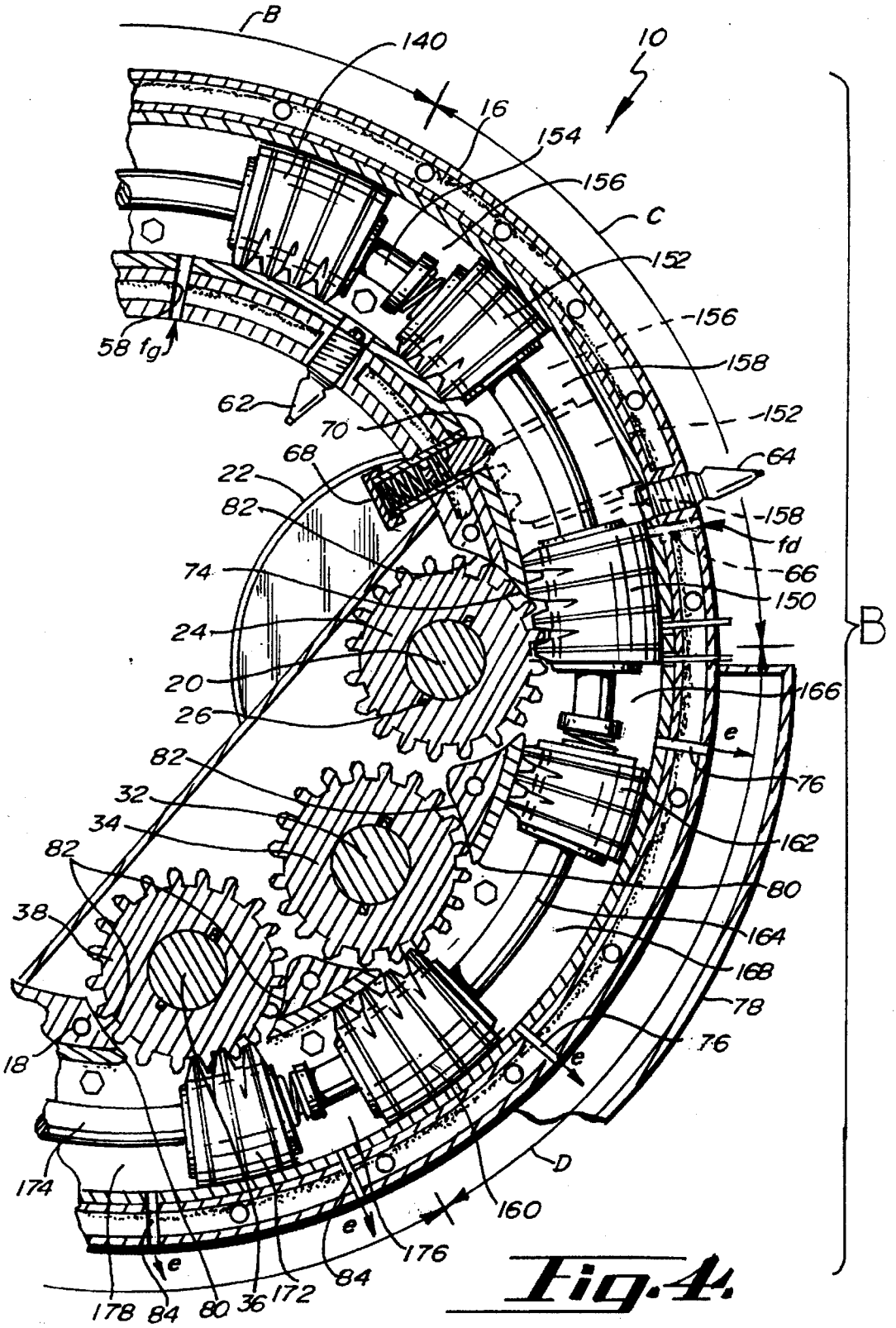
FIG. 4 is an enlarged detailed sectional view of the bracketed B portion of FIG. 2., similar to the bracketed A portion of FIG. 3.

Referring to FIGS. 1–4, the orbiting piston combustion engine 10 of the present invention may be generally understood. The engine 10 includes its ring-like or toroidal cylindrical block 12 from which extends a power shaft 20 connected to power and starting gears and chain assembly 30. Within the cylinder block 12 is located ring-like or toroidal cylinder 90 into which an orbiting piston assembly 100 is positioned. The engine 10 is divided into sections including air intake section A, fuel inlet section B, combustion and ignition section C, power and exhaust section D, further exhaust section E, and scavenging air inlet outlet section F.

More specifically, the toroidal cylinder block 12 may be of a variety of shapes including elliptical or toroidal as is shown. The block 12 is divided into a left section 14 and a right section 16, both of which are held together by fasteners 18 which suitably may be appropriately torqued bolts and nuts. A power shaft 20 extends from the engine 10 and appropriately has mounted thereon a fly wheel and starting gear assembly 22.

At the other end of power shaft 20 is located a first power transfer and starting gear or mechanism 24 which suitably may have a key arrangement 26 affixing the mechanism 24 to the power shaft 20 as is well known. A power and starting gear and chain assembly 30 connects the power shaft 20 to a second shaft 32 with a second power transfer and starting gear 34 and shaft 36 with a third power transfer and starting gear 38. Gears may be surrounded by a cooling, oiling and bearing case or housing 40. A cooling water jacket 44 may also be provided.

Referring to the orbiting sections of the toroidal cylinder block 12 of engine 10, the orbital section A is for air input. A compression piston air port or inlet 50 and a combustion piston air port or inlet 52 permits airflow (arrow a) into the engine 10 from an air intake and scavenging shroud or manifold 54. Orbital section B permits fuel into the engine 10. Compression cylinder fuel port or inlet 56 permits fuel into the engine while combustion cylinder fuel port or inlet 58 also permits fuel flow into the engine (arrow $f_g$). Orbit section C includes a compression cylinder spark ignition means or plug 62 and a combustion cylinder spark ignition means or plug 64. Should the designer wish to utilize diesel fuel, a combustion cylinder diesel fuel injector 66 is provided to permit the flow of diesel fuel (arrow $f_d$). A compression piston stop assembly 68 has a biased beveled stop pin 70 to prohibit the reverse movement of the orbiting piston assembly 100 and to insure that power is in the forward direction of the assembly 100. Orbit section D permits the power transfer from the orbiting piston assembly 100 to the power transfer gears 24, 34 and 38, which are situated in the power and starting gear ports 74. Section D also includes an exhaust port or outlet 76 through which exhaust may escape (arrow e) situated in an exhaust manifold 78. Orbit section E includes power and starting gear port 80 while exhaust gear seals 82 are situated within power and starting gear port 74 and 80. This section also includes exhaust ports 84. Orbit section F includes scavenging air ports or inlets outlets 88.

Within the toroidal cylinder block 12 is located a continuous toroidal cylinder 90 which appropriately may have a toroidal cylinder sleeve 92 which may be replaceable. Within the cylinder 90 is located the orbiting piston assembly 100. For ease of understanding the Figures, the orbiting piston assembly 100 located in orbit section A is described in detail and is similar throughout the piston assembly 100.

The first power piston 102 has power piston rings 104 therearound along with teeth 106 as will be appreciated herein below. Mounted in piston 102 is a forward guidance and push shaft 108 (referred to as the second shaft) by fitting the shaft within a power piston sleeve bearing arrangement 110, which includes an equalizer spring 112 which is shock, expansion and contraction absorbing and will also assist in aligning the piston 102 to the power gears 24, 34 and 38. A sleeve and shaft retainer and spacer plate 114 secure the shaft 108 to the first power piston 102.

A rearward guidance and push shaft (first shaft) 116 supports a first compression piston 118 which has outer rings 120 as well as piston teeth 122. The compression piston 118 is mounted on the guidance and push shaft 116 by way of a compression piston sleeve and bearing arrangement 124 along with compression piston inner rings 126. An equalizer and stopping spring 128 is secured to the compression piston 124 by a compression spring spacer and retainer plate 130. Along the guidance and push shaft 116 is located a stop ring 132.

By this arrangement within the toroidal cylinder 90 is created a first compression chamber 134 and a first combustion chamber 136.

Referring to orbit section B, a second power piston 140 and a second compression piston 142 are mounted on the second guidance and push shaft 108 thereby forming a second compression chamber 144 and a second combustion chamber 146 within the toroidal cylinder 90.

Referring to orbit section C, a third power piston 150 and a third compression piston 152 are mounted on a third guidance and push shaft 154 thereby forming a third compression chamber 156 and a third combustion chamber 158 within the toroidal cylinder 90. Referring to section D, a fourth power piston 160 and a fourth compression piston 162 are mounted on a fourth guidance and push shaft 164 thereby forming fourth compression chamber 166 and fourth combustion chamber 168 within the toroidal cylinder 90.

Referring to orbit section E, a fifth power piston 170 and a fifth compression piston 172 are mounted on a fifth guidance and push shaft 174 thereby forming a fifth compression chamber 176 and a fifth combustion chamber 178 within the toroidal cylinder 90.

Referring to orbit section F, a sixth power piston 180 and a sixth compression piston 182 are mounted on a sixth guidance and push shaft 184 thereby forming a sixth compression chamber 186 and a sixth combustion chamber 188 within the toroidal cylinder 90.

It must be appreciated that the number of pistons and chambers are illustrated herein to show six power strokes in one orbital turn while any number of pistons and chambers may be designed from one to many.

The operation of the orbiting piston combustion engine 10 may now be appreciated showing the six piston arrangement. Firstly, the first compression chamber 134 and first combustion chamber 136 receive air (arrow a) from air ports or inlets 50 and 52. Simultaneously, the second compression chamber 144 and second combustion chamber 146 receive fuel (arrow $f_g$) through fuel ports or inlets 56 and 58. At the combustion or ignition section C, the compression chamber 156, which already has air and fuel therein, is ignited by spark plug 62 which drives the third compression piston 152 forwardly on third guidance and push shaft 154 to pass compression piston stop assembly 68 to phantom position 152. Therefore, third combustion chamber 158 is reduced with the air and fuel highly compressed and ready for ignition of the combustion cylinder spark plug 64. With combustion in the third combustion chamber 158, the third power piston 150 is powerfully force driven in a clockwise arrangement to begin to mesh with power and starting gears 30, 34 and 38. It is noted that the third compression piston 152 cannot rotate or move in a counterclockwise fashion due to the compression piston stop assembly 68. As the third guidance and push shaft 154 accelerates in a clockwise fashion. The stop ring 132 meets the equalizer and stopping spring 128 and also begins movement of the third compression piston 152 in a clockwise fashion to similarly mesh with the referenced gears.

In the power phase of section D, exhaust (arrow e) may leave exhaust port or outlet 76 through exhaust manifold 78. As the orbiting piston assembly 100 continues to rotate clockwise, exhaust may leave exhaust ports 84 in section E while scavenging air enters into the engine through ports or inlets 88 in section F.

Alternatively, should the designer wish to utilize diesel fuel in combustion chambers 136, 146, 158, 168, 178 and 188, combustion cylinder spark plug ignition means, with a sensor, 64 may be replaced with combustion cylinder diesel fuel injector 66 which will permit diesel fuel to ignite upon compression while fuel, such as gasoline, is ignited by spark ignition means or plug 62 in the compression chambers 134, 144, 156, 176 and 186.

It may now be appreciated that power transfer and starting gears or mechanisms 24, 34 and 50 mounted in ports 74 and 80 with gear seals 82 will receive the power transfer from rotating orbiting piston assembly 100 to produce six power strokes to the power shaft 20.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. An orbiting piston combustion engine comprising:

(a) a toroidal cylindrical block with a continuous toroidal cylinder;

(b) a continuously orbiting piston assembly within the continuous toroidal cylinder including a compression piston slidably mounted on a guidance and push shaft with a compression chamber therebehind in the direction of rotation within the cylinder, the compression chamber formed by the cylinder, the compression piston and a power piston, the power piston being rigidly connected to the shaft ahead of the compression piston in the direction of rotation within the cylinder and a combustion chamber behind the power piston in the direction of rotation within the cylinder, the combustion chamber formed by the cylinder, the power piston and the compression piston; and (c) a power transfer mechanism engageable with the continuously orbiting piston assembly for power transfer from the engine.

2. The engine of claim 1, further comprising a power shaft adjacent the block and connected to the power transfer mechanism.

3. The engine of claim 1, wherein the continuously orbiting piston assembly comprises more than one power piston, each of which are interconnected by the guidance and push shaft and separated from the adjacent power piston by one compression piston slideably movable on the push shaft.

4. The engine of claim 1, further comprising inlet ports through the cylinder block for adding air and fuel into the compression and combustion chambers.

5. The engine of claim 1, further comprising a plurality of compression chambers before each power piston and behind each compression piston in the direction of rotation with the cylinder and a plurality of combustion chambers after each power piston and before each compression piston in the direction of rotation within the cylinder.

6. The engine of claim 1, wherein the pistons have teeth thereon which will engagingly mesh with the power transfer mechanism comprised of a gear in a gear port within the cylinder block.

7. The engine of claim 1, wherein the continuously orbiting piston assembly comprises a plurality of power pistons each interconnected by a guidance and push shaft and separated from the adjacent power piston by one compression piston slideably movable on the push shaft with a compression piston stop assembly mounted in the cylinder and a stop ring on the shaft to limit rear movement and push forward the compression piston.

8. The engine of claim 1, wherein the orbital cylindrical block further comprises an air inlet, a fuel inlet, and an ignition for the compression chamber.

9. An orbiting piston combustion engine comprising:

(a) a ring-like cylindrical block with a continuous ring-like cylinder;

(b) a continuously orbiting piston assembly within the continuous cylinder, wherein the continuous orbiting piston assembly comprises more than one power piston with a combustion chamber behind each power piston in the direction of rotation within the cylinder, the combustion chamber formed by the cylinder, the power piston and a compression piston, the power pistons are interconnected by guidance and push shafts and separated from the adjacent power piston by one compression piston slideably movable on the push shaft with a compression chamber behind each compression piston in the direction of rotation within the cylinder, the compression chamber formed by the cylinder, the compression piston and the power piston; and (c) a power transfer mechanism engageable with the continuously orbiting piston assembly for power transfer from the engine.

10. The engine of claim 9, further comprising a power shaft adjacent the block and connected to the power transfer mechanism.

11. The engine of claim 9, further comprising inlet ports through the cylinder block for adding air and fuel into the compression and combustion chambers.

12. The engine of claim 9, further comprising a plurality of compression chambers before each power piston and after each compression piston, relative to the direction of rotation of the piston and a plurality of combustion chambers after each power piston and before each compression piston, relative to the direction of rotation of the piston.

13. The engine of claim 9, wherein the cylinder block is of a toroidal shape.

14. The engine of claim 9, wherein the pistons have teeth thereon which will engagingly mesh with the power transfer mechanism comprised of a gear in a gear port within the cylinder block.

15. The engine of claim 9, wherein power pistons are interconnected by a guidance and push shaft and separated from the adjacent power piston by one compression piston slideably movable on the push shaft with a compression piston stop assembly mounted in the cylinder and a stop ring on the shaft to limit rear movement and pull forward the compression piston.

16. An orbiting piston combustion engine comprising:

(a) a ring-like cylindrical block with a continuous ring-like cylinder;

(b) a continuously orbiting piston assembly within the continuous cylinder including compression pistons with compression chambers therebehind in the direction of rotation within the cylinder, each compression chamber formed by the cylinder, one compression piston and a power piston and further power pistons with combustion chambers therebehind in the direction of rotation within the cylinder, each combustion chamber formed by the cylinder, one combustion piston and one compression piston, wherein the power pistons are each interconnected by a guidance and push shaft and separated from the adjacent power pistons by one compression piston slideably movable on the push shaft with a compression piston stop assembly mounted in the cylinder and a stop ring on the orbiting shaft to limit rear movement and pull forward in the direction of orbit the compression piston; and (c) a power transfer mechanism engageable with the continuously orbiting piston assembly for power transfer from the engine.

17. The engine of claim 16, further comprising a power shaft adjacent the block and connected to the power transfer mechanism.

18. The engine of claim 16, further comprising inlet ports through the cylinder block for adding air and fuel into the compression and combustion chambers.

19. The engine of claim 16, wherein the cylinder block is of a toroidal shape.

20. The engine of claim 16, wherein the pistons have teeth thereon which will engagingly mesh with the power transfer mechanism comprised of a gear in a gear port within the cylinder block.

* * * * *